US010128066B2

(12) United States Patent
Agnatovech et al.

(10) Patent No.: US 10,128,066 B2
(45) Date of Patent: Nov. 13, 2018

(54) TOGGLE SWITCH HAVING IMPROVED MOULDED SEALING COMPONENT, AND ASSEMBLY WITH SUCH A TOGGLE SWITCH AND A SUPPORT PANEL

(71) Applicant: C&K Components S.A.S., Dole (FR)

(72) Inventors: William Agnatovech, Hudson, MA (US); Ken Zhao, Wellesley Hills, MA (US)

(73) Assignee: C&K Components S.A.S., Dole (FR)

( * ) Notice: Subject to any disclaimer, the term of this patent is extended or adjusted under 35 U.S.C. 154(b) by 0 days.

(21) Appl. No.: 15/675,219

(22) Filed: Aug. 11, 2017

(65) Prior Publication Data

US 2018/0053612 A1 Feb. 22, 2018

Related U.S. Application Data

(60) Provisional application No. 62/376,093, filed on Aug. 17, 2016.

(51) Int. Cl.

| | |
|---|---|
| ***H01H 23/06*** | (2006.01) |
| ***H01H 3/04*** | (2006.01) |
| ***H01H 23/14*** | (2006.01) |
| *H01H 9/04* | (2006.01) |

(52) U.S. Cl.

CPC ..... *H01H 23/065* (2013.01); *H01H 3/04* (2013.01); *H01H 23/146* (2013.01); *H01H 2009/048* (2013.01)

(58) Field of Classification Search

CPC ..... H01H 23/065; H01H 3/04; H01H 23/146; H01H 2009/048; H01H 23/06; H01H 11/00; H01H 21/22; H01H 21/08; H01H 2021/225

USPC ..... 200/302.3, 333, 335, 339, 302.1, 553

See application file for complete search history.

(56) References Cited

U.S. PATENT DOCUMENTS

| | | | | |
|---|---|---|---|---|
| 2,916,592 | A * | 12/1959 | Campe | H01H 23/06 200/296 |
| 3,483,345 | A | 12/1969 | Hults | |
| 4,109,126 | A * | 8/1978 | Halbeck | H01H 9/12 200/302.3 |
| 6,710,273 | B1 | 3/2004 | Skarlupka et al. | |
| 7,964,812 | B1 * | 6/2011 | Schwinn | H01H 9/04 200/302.3 |
| 9,018,553 | B1 * | 4/2015 | Arnold | H01H 23/06 200/302.3 |

* cited by examiner

*Primary Examiner* — Edwin A. Leon

(74) *Attorney, Agent, or Firm* — Fox Rothschild LLP

(57) ABSTRACT

A toggle switch includes a hollow base, a switch mechanism, a cover, a bushing extending from the cover, a toggle lever, and a one piece resilient sealing component. The sealing component includes a lever seal surrounding the toggle lever and covering the inner wall of the bushing for sealing a space between the toggle lever and the bushing. A cover seal forms a lower closed sealing ring compressed between the cover and the base for sealing the cover to the base. The one piece resilient sealing component also includes an upper closed sealing ring surrounding the bushing and extending on a portion of the upper surface of the cover for cooperating with a panel for mounting the switch.

19 Claims, 6 Drawing Sheets

TOGGLE SWITCH HAVING IMPROVED MOULDED SEALING COMPONENT, AND ASSEMBLY WITH SUCH A TOGGLE SWITCH AND A SUPPORT PANEL

RELATED APPLICATIONS AND CLAIM OF PRIORITY

This patent document claims priority to U.S. provisional patent application No. 62/376,093, filed Aug. 17, 2016, the disclosure of which is fully incorporated into this document by reference.

BACKGROUND

This document relates to toggle switches, and in an embodiment to the sealing of toggle switches, such as panel mounted toggle switches, in order to prevent moisture and other contaminants from passing through the switch.

Toggle switches are used in a variety of applications and are frequently mounted to panels such that the toggle levers of the toggle switches protrude from one upper side or surface of the panels and extend through holes of the panels to operate switches on the lower side of the panels.

A toggle switch has a toggle lever that is typically pivoted about a pin in order to control the position of the switch. The pin passes through a bushing and the toggle lever so as to support the toggle lever.

U.S. Pat. No. 3,483,345, the disclosure of which is fully incorporated into this document by reference, discloses a toggle switch comprising a hollow base open at the top for accommodating a switch mechanism, a cover closing the top of the base, and a bushing vertically extending upwardly from the cover. A toggle lever extends through the bushing and is pivotally mounted with respect to the bushing. The toggle switch also includes a one piece moulded resilient sealing component comprising a lever seal surrounding the toggle lever and covering the inner wall of the bushing for sealing the space between the toggle lever and the bushing, and a cover seal forming a lower closed sealing ring that is compressed between the cover and the upper portion of the base for sealing the cover to the base.

It is also necessary to seal the holes in the panel sealing in order to prevent moisture and other contaminants from passing from one side of the panel to the other side of the panel. This is normally accomplished by a separate O-ring type seal.

According to the known solutions, a first nut is screwed onto the bushing, then the O-ring seal is seated around the bushing, then the bushing is inserted through the panel opening, and then a second nut is used to tighten the switch to the panel.

This patent document discloses a new solution for sealing provisions in connection with a panel to which a toggle switch is mounted.

SUMMARY

In an embodiment, a toggle switch of the above type has a base that is open at the top for accommodating a switch mechanism, a cover closing the top of the base, a bushing extending vertically and upwardly from the cover, and a toggle level extending through the bushing and pivotally mounted with respect to the bushing. A one-piece resilient sealing component includes a lever seal surrounding the toggle lever and covering an inner wall of the bushing for sealing a space between the toggle lever and the bushing.

The sealing component also includes a cover seal forming a lower closed sealing ring that is compressed between the cover and the upper portion of the hollow base for sealing the cover to the base. The sealing component also includes an upper closed sealing ring surrounding the bushing and extending on a portion of the upper surface of the cover.

The above-mentioned complexity of the panel sealing arrangements is thus avoided by having a single integrated upper sealing ring on the top surface of the cover to seal between the cover and the panel.

In accordance with an embodiment, the cover comprises at least one through hole, and the resilient sealing component comprises a connecting portion extending through the hole for connecting the upper closed sealing ring to the lower closed sealing ring.

Optionally, the cover may include several through holes arranged around the bushing and the moulded resilient sealing component may comprise several connecting portions, each of them extending through an associated hole for connecting the upper closed sealing ring to the closed sealing ring.

Each through hole may extend vertically, and the connecting portion may include a vertical pillar. The portion of the upper surface of the cover may comprise a closed groove receiving a lower part of the upper closed sealing ring. The upper closed sealing ring may be in the shape of a planar sealing ring comprising a planar horizontal upper surface. The cover may be in the shape of a lower horizontal cover plate comprising an upper horizontal surface on which the upper closed sealing ring extends.

In another embodiment, the switch may include a panel element having a central opening through which the bushing is extending, and a nut screwed on the threaded bushing for pressing the upper closed sealing ring between a portion of a lower surface of the panel and said portion of an upper surface of the cover.

In an alternate embodiment, a toggle switch includes a base having a cover, a pivoting toggle lever extending from the base through the cover, and a one piece resilient sealing component. The sealing component includes a lever seal surrounding the toggle lever, a cover seal forming a lower closed sealing ring that is compressed between the cover and an upper portion of the base for sealing the cover to the base, and an upper closed sealing ring that extends on a portion of the upper surface of the cover.

Optionally, in the alternate embodiment, the cover may include at least one through hole, and the resilient sealing component may include at least one connecting portion extending through each through hole for connecting the upper closed sealing ring to the lower closed sealing ring. The toggle switch also may include a bushing extending from the cover, and the lever seal may be configured to seal a space between the toggle lever and the bushing. Optionally, each through hole may extend vertically, and each connecting portion may include a vertical pillar. A portion of the upper surface of the cover may include a closed groove that receives a lower part of the upper closed sealing ring. The upper closed sealing ring may be in the shape of a planar sealing ring with a planar horizontal upper surface. The cover may be in the shape of a lower horizontal cover plate including an upper horizontal surface on which the upper closed sealing ring extends. The toggle switch also may include a panel element having a central opening through which the bushing extend, along with a nut connected to the bushing for pressing the upper closed sealing ring between a portion of a lower surface of the panel and the element portion of an upper surface of the cover.

BRIEF DESCRIPTION OF THE DRAWINGS

These and other features and advantages will become more apparent from a detailed consideration of the invention when taken in conjunction with the drawings in which.

DETAILED DESCRIPTION

In the description that follows, identical, similar or analogous components are designated by the same reference numbers.

As a non-limiting example, to assist in understanding the description and the claims, the terms vertical, horizontal, bottom, top, up, down, transversal, longitudinal, and so on will be adopted with reference to the L, V, T trihedron indicated in the figures, and without any reference to the gravity. Similarly, the terms "upper" and "lower" are intended to be terms used in reference to each other, and not necessarily with reference to ground.

As used in the attached document, the term "comprising" (or "comprises") means "including (or includes), but not limited to."

Figure 1:
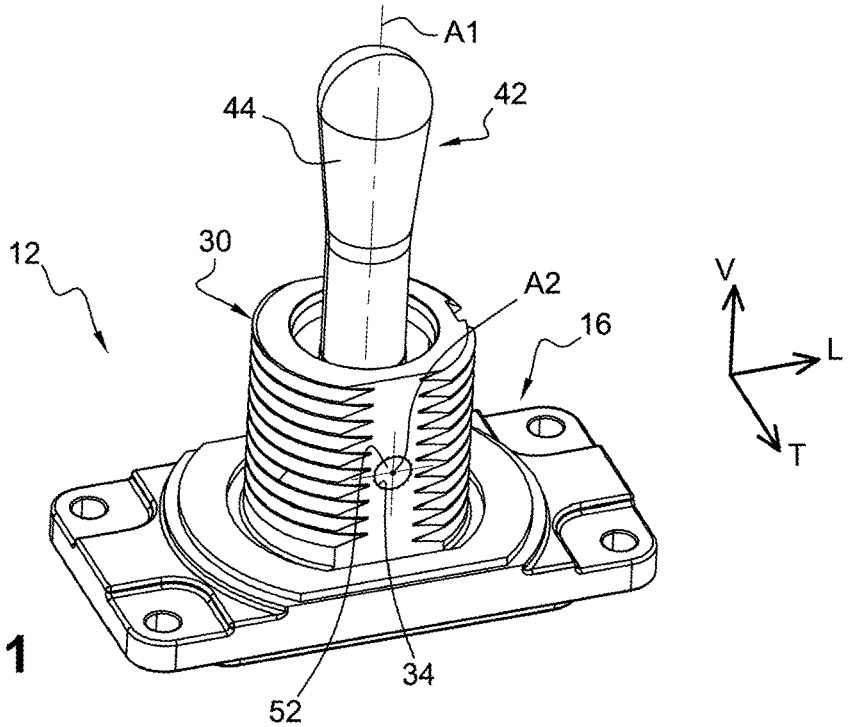
FIG. 1 is a top perspective view which partly illustrates a first embodiment of a toggle switch providing for two distinct switching positions.
Figure 2:
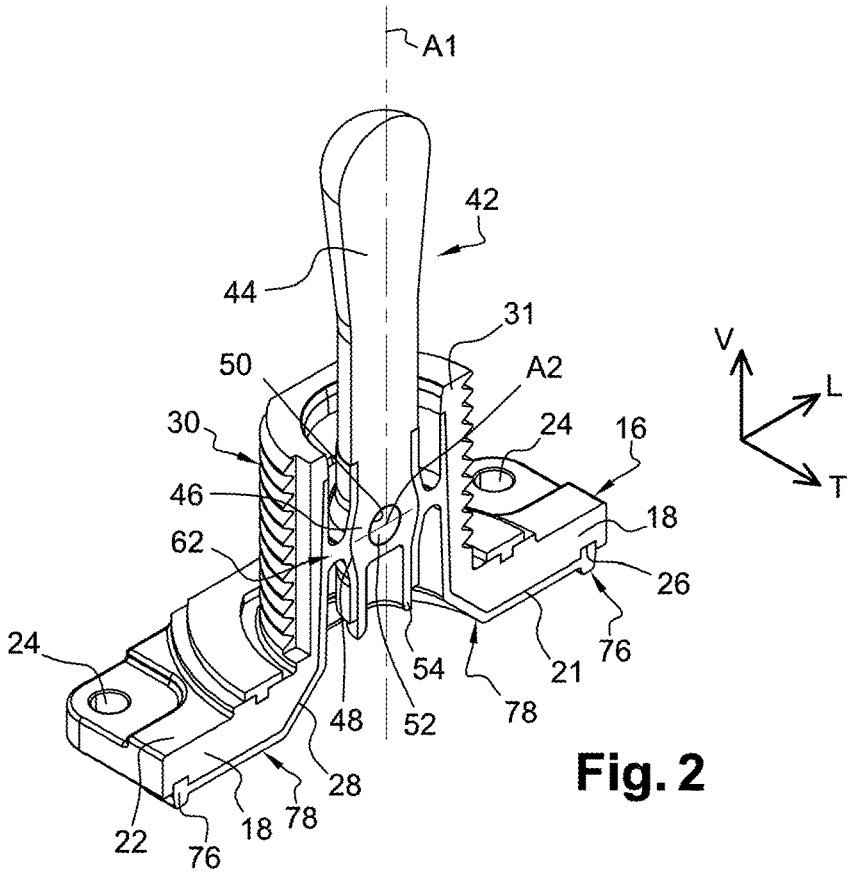
FIG. 2 is a perspective view similar to FIG. 1 showing some of the main components in section along a vertical and longitudinal median plane.
Figure 3:
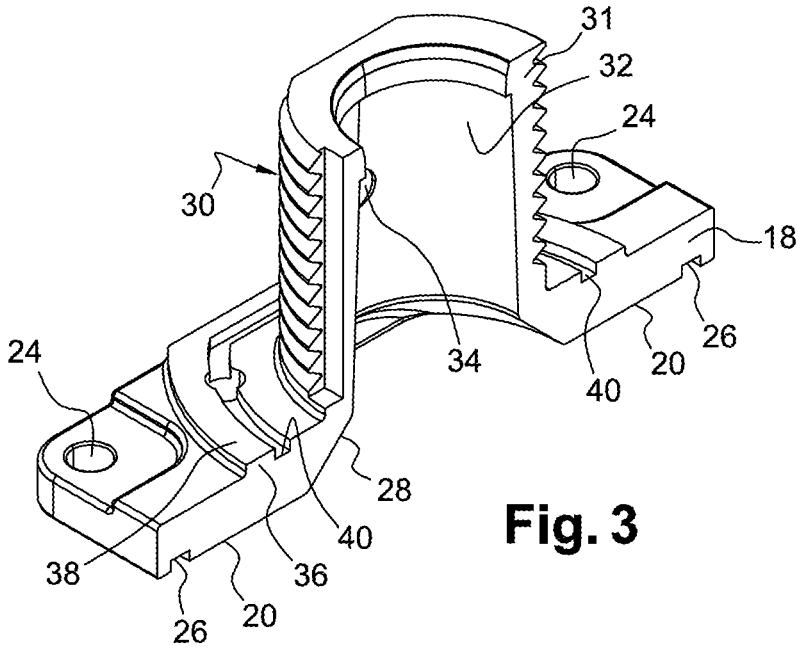
FIG. 3 is a view similar to the one of FIG. 2 illustrating solely the cover of the toggle switch.
Figure 4:
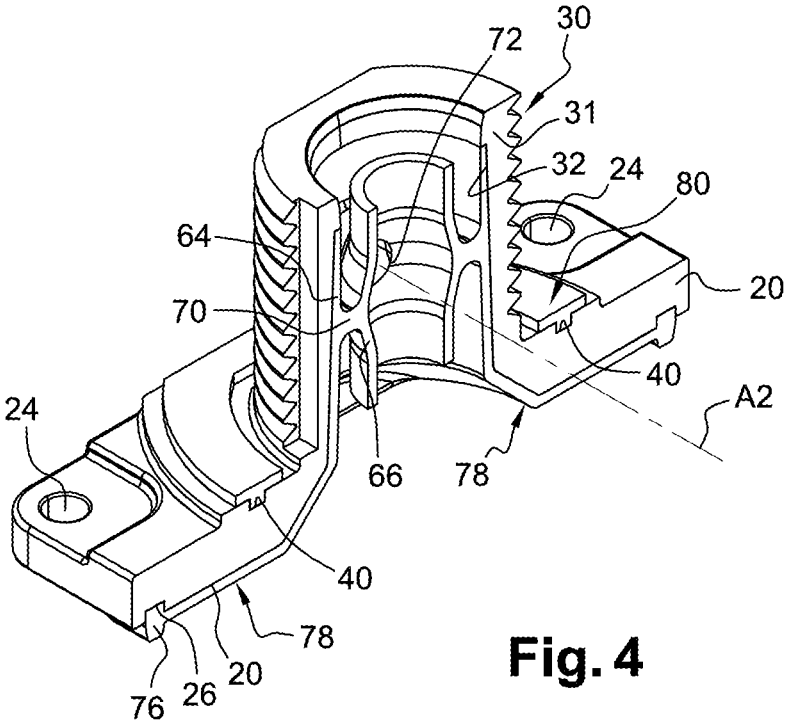
FIG. 4 is a view similar to the one of FIG. 3 illustrating the cover of the toggle switch together with an embodiment of a moulded sealing component.
Figure 5:
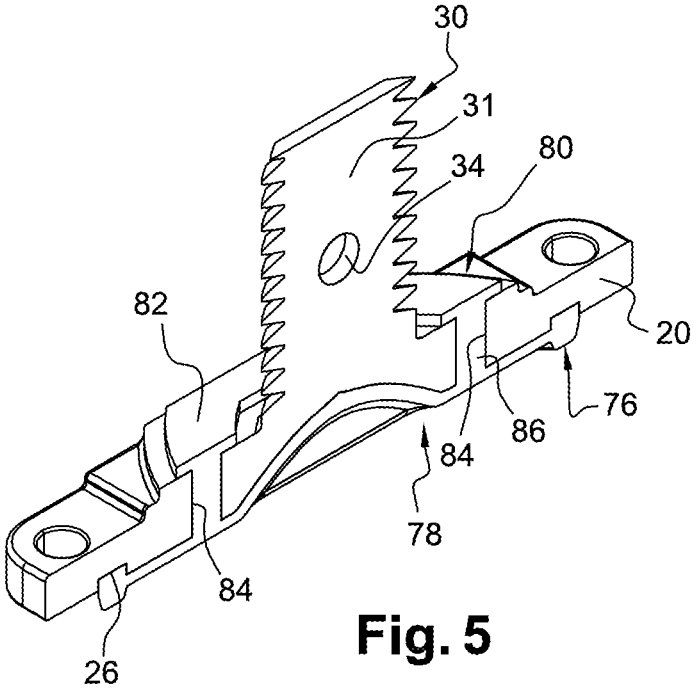
FIG. 5 is a view similar to the one of FIG. 4 where the same components are illustrated through another vertical and longitudinal section plan.
Figure 6:
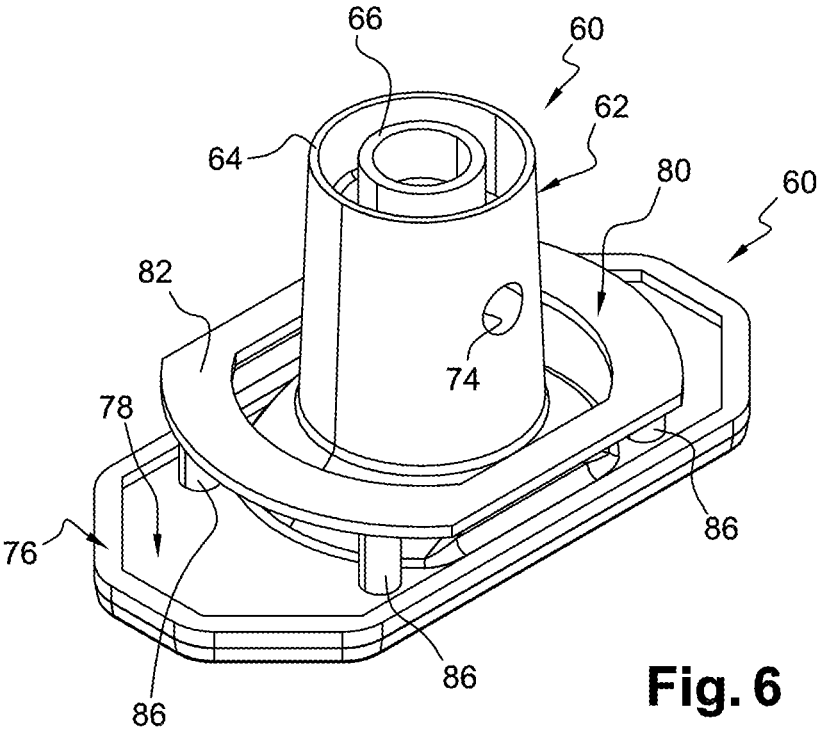
FIG. 6 is a perspective view illustrating the resilient moulded sealing component isolated from the other components.

In the illustrated first embodiment (shown in FIGS. 1-6), the design of the whole switch is globally symmetrical with respect to the vertical and longitudinal median section plane of FIG. 2, and also with respect to the orthogonal vertical and transversal median plane.

Figure 7:
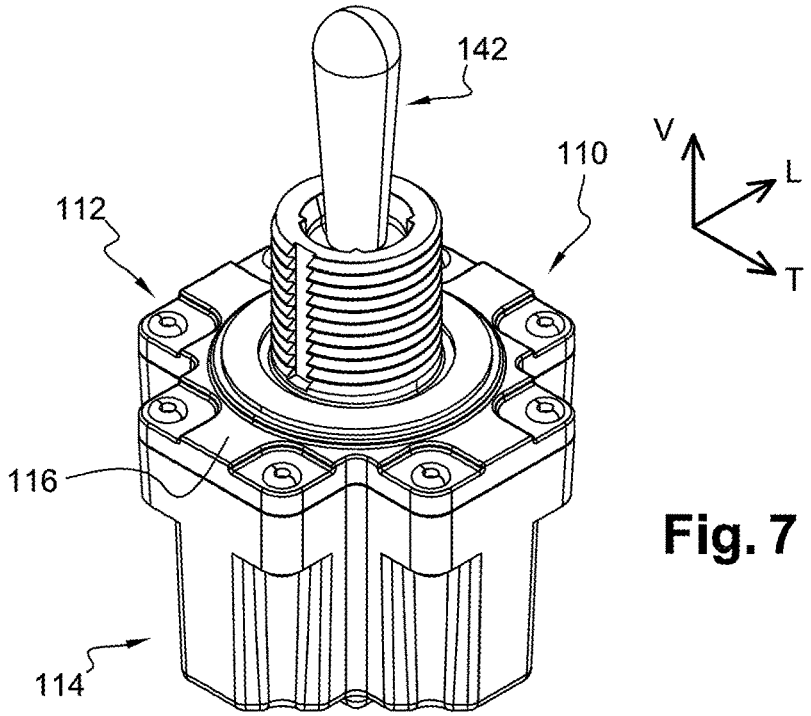
FIGS. 7 and 8 are views similar to those of FIGS. 1 and 2 showing a second embodiment of a toggle switch providing for four distinct switching positions.
Figure 8:
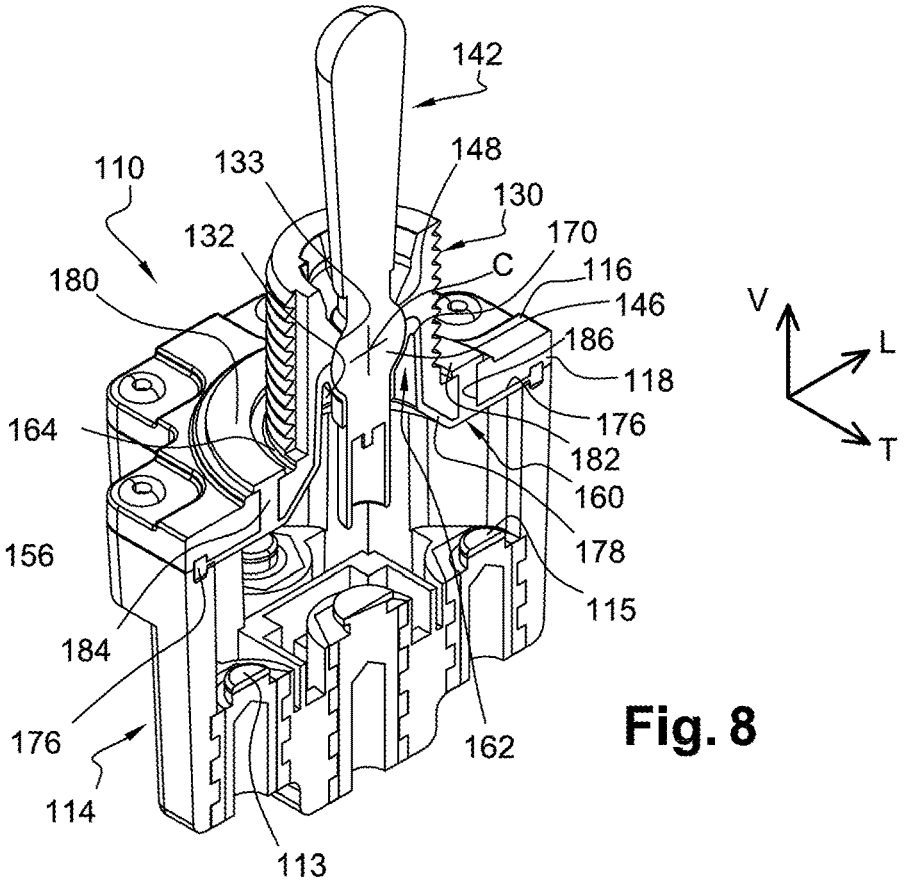

FIG. 1 shows the upper portion 12 of a toggle switch of the type disclosed in U.S. Pat. No. 3,483,345, having a hollow base (not shown in this embodiment, but shown in an embodiment of FIG. 7 and up) open at its top for accommodating an electrical switch mechanism (not shown).

The upper portion 12 comprises a cover 16 designed for being complementary to the hollow base and for closing the top or upper open surface of the hollow base.

The cover is in the form of a horizontal rectangular plate which is a metallic one delimited by a lower horizontal surface and an upper horizontal surface. In each one of the four corners of the cover plate 18, there is provided a through hole 24 extending vertically for the passage of a connecting structure such as a bolt, pin, rivet or other connector for fixing the cover plate, and thus the cover 16, on the hollow base. Although four through holes 24 are described in this embodiment, any number of through holes and connecting structures may be used.

A substantially annular peripheral closed lower groove 26 (open downwardly) is formed in the lower surface 20 and is designed for receiving a cover seal cooperating with a corresponding surface portion of the upper surface of the hollow base for having a sealing between the cover and the hollow base after assembly thereof.

The cover plate 18 also comprises a central frustoconical central through hole 28.

The cover 16 also comprises a bushing 30 extending vertically and upwardly from the upper surface 22 of the cover plate 18.

The bushing 30 is a hollow cylindrical element made in one piece with the cover plate 18 and that is threaded outwardly for cooperating with a tightening nut (not shown) for fixing the switch for example on a panel.

The bushing 30 delimitates an interior vertical cylindrical concave wall 32 which extends in the extension of the central hole 28.

The bushing 30 extends along a vertical axis A1.

Substantially at mid-height, the tubular wall 31 of the bushing 30 comprises a horizontal through hole in the form of two opposite and aligned holes 34 extending horizontally along a horizontal axis A2 that is concurrent to the vertical axis A1.

Around the lower portion of the bushing 30, the upper surface 22 comprises a substantially annular and continuous shoulder 36 having an upper horizontal surface 38 in which a substantially annular closed upper groove 40 (open upwardly) is formed.

The upper groove 40 is designed for receiving an upper switch seal cooperating with a corresponding surface portion for example of a lower surface of a panel on which the switch is fixed.

The upper portion 12 of the toggle switch also comprises a toggle lever 42 which is in the general form of a vertical stem centrally and vertically extending along the vertical axis A1 of the bushing 30.

The toggle lever comprises an upper portion 44 vertically and centrally protruding outside of the bushing 30. This upper portion is the actuating portion of the toggle lever for actuation of the switch mechanism, for example by manipulation by the hand of a user.

The toggle lever 42 comprises an intermediary medium portion 46 for its pivotal mounting with respect to the bushing 30 around the horizontal axis A2.

The medium portion is received substantially at mid-height inside the bushing 30 and is delimited outwardly by a convex and substantially spherical surface 48 facing the internal wall 32.

The medium portion comprises an horizontal through hole 50.

The pivotal mounting is ensured by means of a horizontal pivoting shaft 52 which is received in holes 34 and 50 thus allowing a pivotal movement, in the two directions, of the toggle lever 42 in the vertical and longitudinal median plane.

The toggle lever comprises a lower portion 54 vertically and centrally extending in the lower portion of the bushing 30. This lower portion is the portion acting (through any suitable non illustrated means) on the switch mechanism arranged in the hollow base.

The upper portion 12 comprises a one piece moulded resilient sealing component 60 comprising a toggle lever seal 62 surrounding the medium portion 46 of the toggle lever 42, and covering the inner wall 32 of the bushing 30 for sealing the space between the toggle lever 42 and the bushing.

To this end, this toggle lever seal 62 comprises an outer tubular skirt 64 moulded in place on the inner wall of the bushing 30, an inner tubular skirt 66 for receiving, by vertical axial introduction, the medium portion 46 of the toggle lever. The inner skirt 66 is moulded in one piece with the outer skirt 64 to which it is connected by a horizontal flexible joining annular lip 70.

In the plane of the lip 70, both the outer skirt 66 and the inner skirt 68 respectively comprises horizontal through holes 72 and 74 respectively which are aligned with the holes 34 and 52 of the bushing 30 and of the toggle lever 42, for permitting the mounting of the pivoting shaft 52 therethrough.

The one piece moulded resilient sealing component 60 comprises a cover seal forming a lower closed sealing ring that is compressed between the cover and the upper portion of the hollow base for sealing the cover to the hollow base.

The cover seal is in the shape of a substantially annular closed sealing ring 76 the profile of which is complementary to the profile of the lower groove 26 in which it is partially received. A portion of the lower sealing ring 76 protrudes vertically downwardly outside of its receiving groove for cooperating with the hollow base.

The lower sealing ring 76 is connected to the toggle lever seal 62 by a joining portion 78 in the form of a moulded sheet which fits to the shape of the hole 28 and to the shape of the lower surface 20 of the cover plate 18 and which is moulded thereon.

According to an embodiment, the one piece moulded resilient sealing component 60 comprises an upper closed sealing ring 80 surrounding the bushing 30.

The upper sealing ring 80 forms an upper closed ring around the bushing 30 and that might be compressed between the cover plate 18 and the lower surface of a panel for sealing the panel to the switch.

The upper sealing ring 80 seal is in the shape of a substantially annular closed ring the profile of which is complementary to the profile of the upper groove 40 in which it is partially received. A portion of the upper sealing ring 80 protrudes vertically upwardly outside of its receiving groove 40 for cooperating with the lower surface of a panel.

The upper sealing ring 80 is in the shape of a planar sealing ring comprising a planar horizontal upper surface 82.

According to the illustrated embodiment, for moulding in place and in one piece the moulded resilient sealing component 60 comprising the upper sealing ring 80, the cover plate comprises here a number through holes 84 which extend vertically through the cover plate 18.

The one piece moulded resilient sealing component 60 comprises four (or any number of) corresponding connecting portions 86, each one in the form of a vertical pillar, each one extending through an associated one of the through holes for connecting said upper sealing ring 80 to the lower sealing ring.

The connecting pillars are moulded in one piece simultaneously with the other parts and portions 62, 76 and 80 of the sealing component 60.

A second embodiment illustrated at FIGS. 7 to 10, will now be described by comparison with the first embodiment using the same numeral references where applicable.

FIGS. 7 through 10 illustrate a toggle switch 110 comprising an upper portion 112 with a cover 116 sealed according to an embodiment, and a lower hollow base 114. A number of through holes 124 may be provided for receiving bolts, pins, rivets or other connecting structures that connect the cover 116 to the base 114.

The switch mechanism (not illustrated) contained in the hollow base 114 cooperate with four fixed contacts 115 four contacts angularly distributed at a right angle.

For establishing a contact, and a corresponding switching way, with one or the other of these fixed contacts, the toggle lever 142 is rotatably mounted with respect to the bushing 130 around a center "C" in the manner of a ball joint.

To this end, the convex spherical surface 148 of the medium portion 146 of the toggle lever 142 cooperates with a complementary concave spherical surface 133 formed in the wall 132 of the bushing 130.

This embodiment also may include a one piece resilient sealing component 160 comprising an upper sealing ring 180, and four (or any number of) corresponding connecting portions 186, each of which is configured and positioned to be received by a corresponding through hole 184 of the cover plate 118 for connecting the upper sealing ring 180 to a lower sealing structure 176. A seal membrane 178 may be positioned to connect the upper seal 180 to the lower seal structure 176.

When compared with the first embodiment, it is to be noted that the toggle lever seal 162 surrounding the medium portion 146 of the toggle lever 142 and covering the inner wall 132 of the bushing 130 for sealing the space between the toggle lever 142 and the bushing comprises only a low portion of the outer tubular skirt 164 moulded in place on the inner wall 132 of the bushing 130, and only a low portion of the inner tubular skirt 166. These low portions of the inner skirt 166 and of the outer skirt 164 are moulded in one piece and connected by an upper flexible joining annular lip 170.

Figure 9:
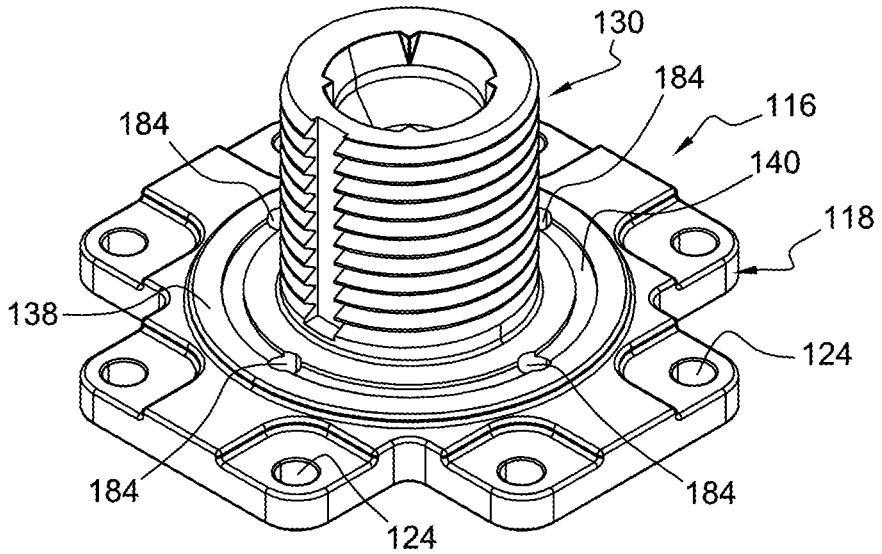
FIG. 9 is a perspective view illustrating the cover of the toggle switch of FIGS. 7 and 8.
Figure 10:
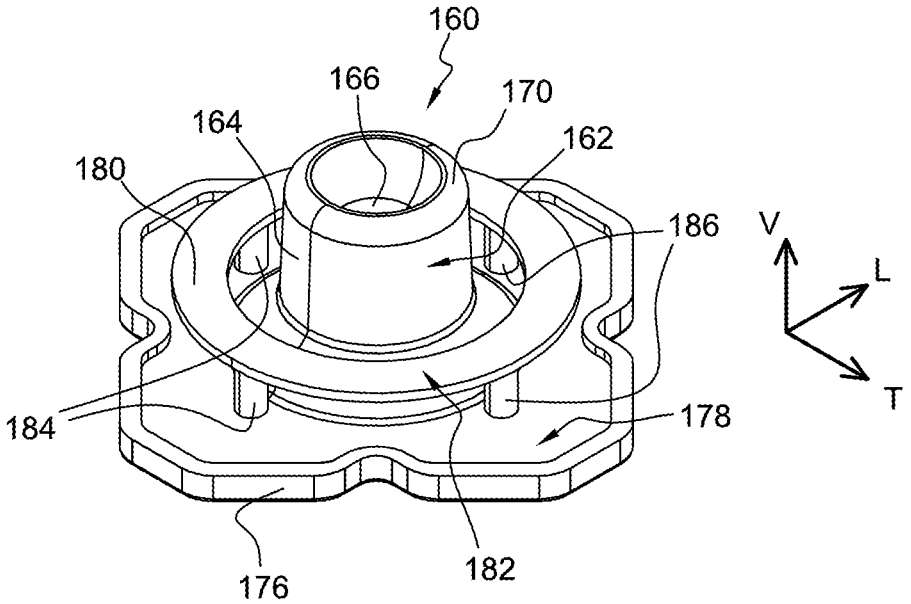
FIG. 10 is a perspective view similar to the one of FIG. 6 illustrating the resilient moulded sealing component of the toggle switch of the switch of FIGS. 7 and 8.
Figure 11:
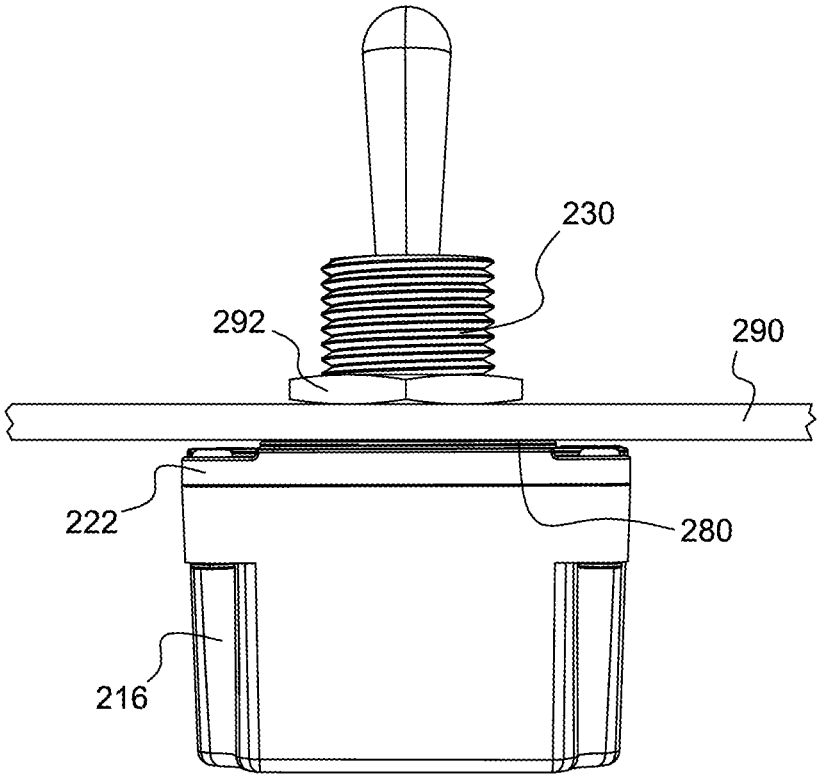
FIG. 11 illustrates an additional embodiment.

In either embodiment, the bushing may be threaded as shown in FIG. 9. As shown in FIG. 11, the bushing 230 may extend upward through an opening of a horizontal panel element 290. A nut 292 may be screwed on the threaded bushing 230 for pressing the upper sealing ring 280 between a portion of a lower surface of the panel 290 and a portion of an upper surface 222 of the cover 216.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A toggle switch comprising:

a base open at its top for accommodating a switch mechanism;

a cover closing the top of the base;

a bushing vertically and upwardly extending from the cover;

a toggle lever extending through the bushing and pivotally mounted with respect to the bushing; and a one piece resilient sealing component comprising:

a lever seal surrounding the toggle lever and covering an inner wall of the bushing for sealing a space between the toggle lever and the bushing, and a cover seal forming a lower closed sealing ring that is compressed between the cover and the upper portion of the base for sealing the cover to the base, wherein the resilient sealing component comprises an upper closed sealing ring surrounding the bushing and extending on a portion of the upper surface of the cover.

2. The toggle switch of claim 1, wherein:

the cover comprises a through hole; and the resilient sealing component comprises a connecting portion extending through the through hole for connecting the upper closed sealing ring to the lower closed sealing ring.

3. The toggle switch of claim 2, wherein:

the cover comprises a plurality of through holes arranged around the bushing; and the resilient sealing component comprises a plurality of connecting portions, each of the connecting portions extending through one of the through holes for connecting the upper closed sealing ring to the lower closed sealing ring.

4. The toggle switch according to claim 2, wherein the through hole extends vertically and the connecting portion comprises a vertical pillar.

5. The toggle switch according to claim 3, wherein the through holes extend vertically and each of the connecting portions comprises a vertical pillar.

6. The toggle switch claim 1, wherein a portion of the upper surface of the cover comprises a closed groove that receives a lower part of the upper closed sealing ring.

7. The toggle switch of claim 1, wherein the upper closed sealing ring is in the shape of a planar sealing ring comprising a planar horizontal upper surface.

8. The toggle switch of claim 1, wherein the cover is in the shape of a lower horizontal cover plate comprising an upper horizontal surface on which the upper closed sealing ring extends.

9. The toggle switch of claim 1, wherein the resilient sealing component is a one-piece molded component.

10. The toggle switch of claim 1, further comprising;

a panel element having a central opening through which the bushing extends; and a nut screwed on the bushing for pressing the upper closed sealing ring between a portion of a lower surface of the panel and the element portion of an upper surface of the cover.

11. A toggle switch comprising:

a base having a cover;

a pivoting toggle lever extending from the base through the cover; and a one piece resilient sealing component comprising:

a lever seal surrounding the toggle lever, a cover seal forming a lower closed sealing ring that is compressed between the cover and an upper portion of the base for sealing the cover to the base, and an upper closed sealing ring that extends on a portion of the upper surface of the cover.

12. The toggle switch of claim 11, wherein:

the cover comprises at least one through hole; and the resilient sealing component comprises at least one connecting portion extending through each through hole for connecting the upper closed sealing ring to the lower closed sealing ring.

13. The toggle switch of claim 12, further comprising:

a bushing extending from the cover; and wherein the lever seal is configured to seal a space between the toggle lever and the bushing.

14. The toggle switch according to claim 12, wherein each through hole extends vertically and each connecting portion comprises a vertical pillar.

15. The toggle switch claim 11, wherein a portion of the upper surface of the cover comprises a closed groove that receives a lower part of the upper closed sealing ring.

16. The toggle switch of claim 11, wherein the upper closed sealing ring is in the shape of a planar sealing ring comprising a planar horizontal upper surface.

17. The toggle switch of claim 11, wherein the cover is in the shape of a lower horizontal cover plate comprising an upper horizontal surface on which the upper closed sealing ring extends.

18. The toggle switch of claim 11, wherein the resilient sealing component is a one-piece molded component.

19. The toggle switch of claim 12, further comprising;

a panel element having a central opening through which the bushing extends; and a nut connected to the bushing for pressing the upper closed sealing ring between a portion of a lower surface of the panel and the element portion of an upper surface of the cover.

* * * * *